US009301592B2

(12) United States Patent
Hofmann

(10) Patent No.: US 9,301,592 B2
(45) Date of Patent: Apr. 5, 2016

(54) MULTI-PURPOSE MAKEUP APPLICATOR

(71) Applicant: M.Y.H Ltd, Kennedy Town (HK)

(72) Inventor: Melanie Yeh Hofmann, Kennedy Town (HK)

(73) Assignee: M.Y.H LTD, Kennedy Town (HK)

( * ) Notice: Subject to any disclaimer, the term of this patent is extended or adjusted under 35 U.S.C. 154(b) by 327 days.

(21) Appl. No.: 13/959,559

(22) Filed: Aug. 5, 2013

(65) Prior Publication Data

US 2014/0037360 A1 Feb. 6, 2014

Related U.S. Application Data

(60) Provisional application No. 61/680,178, filed on Aug. 6, 2012.

(51) Int. Cl.

| | |
|---|---|
| ***A45D 40/26*** | (2006.01) |
| ***A46B 5/00*** | (2006.01) |
| ***A46B 7/02*** | (2006.01) |

(52) U.S. Cl.

CPC ..... *A45D 40/265* (2013.01); *A45D 40/267* (2013.01); *A46B 5/0008* (2013.01); *A46B 7/026* (2013.01); *A46B 2200/1046* (2013.01); *A46B 2200/1053* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,376,641 | B2 * | 2/2013 | Fraillon | A45D 40/20 401/19 |
| 8,783,989 | B2 * | 7/2014 | Weigel | A45D 40/24 132/218 |
| 8,944,713 | B2 * | 2/2015 | Koguchi | A45D 40/205 401/126 |
| 2006/0056902 | A1 | 3/2006 | Susini et al. | |
| 2011/0297174 | A1 | 12/2011 | Ornoski et al. | |
| 2012/0082502 | A1 | 4/2012 | Koguchi | |

FOREIGN PATENT DOCUMENTS

| | | | |
|---|---|---|---|
| CN | 151001 | A | 7/2004 |
| CN | 202051151 | | 11/2011 |
| CN | 102293507 | | 12/2011 |
| CN | 102440513 | A | 5/2012 |

* cited by examiner

*Primary Examiner* — David Walczak
(74) *Attorney, Agent, or Firm* — Loza & Loza LLP; Heidi L. Eisenhut

(57) ABSTRACT

A multi-purpose makeup applicator. The applicator includes a handle, a hollow elongated shaft extending longitudinally outward from the handle, a first applicator located within the shaft and a second applicator formed on the shaft. The first applicator comprises an elongated member, affixed to the handle at one end, and an applicator tool affixed to a second, opposite end. The elongated member of the first applicator is a retractable eyeliner tool for applying cosmetics around the eyes. The second applicator is coupled to the distal end of the shaft and comprise bristles extending outwardly from the shaft forming a brush used to apply cosmetics, such as mascara. A twist and slide mechanism may be located in the handle for retracting and/or extending the first applicator. The second applicator can retract/extend into/out of the elongated shaft or can remain in a permanent extended position.

17 Claims, 13 Drawing Sheets

MULTI-PURPOSE MAKEUP APPLICATOR

CLAIM OF PRIORITY UNDER 35 U.S.C. §119

The present Utility Application for Patent claims priority to U.S. Provisional Application No. 61/680,178 entitled "MULTI-PURPOSE MAKEUP APPLICATOR" filed Aug. 6, 2012, and hereby expressly incorporated by reference herein.

FIELD

At least one feature pertains to a multi-purpose makeup applicator/tool.

BACKGROUND

There are numerous cosmetic products in the market. Each one is designed to enhance, improve, alter and/or change the appearance of one or more features of a person. Examples of cosmetic products include lipstick, foundation, blush, mascara and eyeliner. In many instances, each particular cosmetic product requires a special applicator (or tool) to apply that particular cosmetic product on a person.

Mascara is an example of a cosmetic product that requires a special applicator (or tool). Mascara is used to darken, thicken or lengthen eyelashes. Typically, an applicator is used to apply mascara to the eyelashes. The applicator has a brush or bristles and is dipped in a container that has mascara. The brush picks up the mascara and mascara is applied to the eyelashes by brushing the brush with the mascara on the eyelashes.

Eyeliner is another example of a cosmetic product that requires a special applicator (or tool). Eyeliner is used to define the eyes. It is applied around the contours of the eye to create a variety of aesthetic features. Eyeliner may come in different forms and may be applied differently. In one example, eyeliner is applied through the use of a pencil like tool or thin, compressed eye liner brush. In such an instance, the eyeliner is located at the tip of the pencil like tool and is applied by brushing the eyeliner around the contours of the eyes.

The above cosmetic products are just two examples of the many cosmetic products on the market. Most people have and use a lot more cosmetic products. Thus, it is clear that a person may have numerous tools and applicators in their homes.

This is problematic because cosmetic products and their respective applicators (or tools) take up a lot of space and create a lot of clutter. The sheer number of cosmetic products and tools is especially troublesome and cumbersome when traveling. It would be ideal to minimize the number of items that is packed when traveling, but that is difficult to achieve when each cosmetic product requires its own specific tool.

Consequently, what is needed is a makeup applicator (or tool) that can be used for multiple purposes. Specifically, there is a need for a multi-purpose makeup tool or applicator which is lightweight, portable and fully functional without sacrificing any of the functionality of each tool that the multi-purpose tool is replacing.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspect of the disclosure. Its sole purpose is to present some concepts of one or more aspects of the disclosure in a simplified form as a prelude to the more detailed description that is presented later.

In one example, the disclosure provides a multi-purpose makeup applicator. The multi-purpose makeup applicator includes a handle; a first retractable applicator coupled to the handle, the first retractable applicator for applying a first cosmetic product; and a second retractable applicator coupled to the handle, the second retractable applicator for applying a second cosmetic product. Both the first and second retractable applicators may have an open position and a closed position.

According to one aspect, when the first retractable applicator is in a maximized position, the second retractable applicator is in a minimized position. Conversely, when the first retractable applicator is in a minimized position, the second retractable applicator is in a maximized position.

According to one aspect, the first retractable applicator is an eyeliner applicator for applying eyeliner around eyes and the second retractable applicator includes a brush for applying mascara to eyelashes.

In another example, the disclosure provides a multi-purpose makeup tool/applicator. In this example, the multi-purpose make-up tool/applicator includes a handle; an elongated member affixed to the handle at a first end and a first applicator affixed to a second, opposite end and adapted for applying a first cosmetic product; a hollow elongated shaft having a proximal end and a distal end, the proximal end in contact with, and extending longitudinally outward from, the handle and a second applicator affixed to the distal end and adapted for applying a second cosmetic product; and where the elongated member is retractably located within the hollow elongated shaft.

In one aspect, the multi-purpose make-up tool/applicator further includes a knob located within the handle, the knob rotatable between an open position and a closed position. When the knob is in the closed position, the elongated member is in a fully retracted position and when the knob is in the open position, the elongated member is a fully extended position and the first applicator is exposed for application.

In one aspect, the first applicator is an eyeliner applicator for applying eyeliner around eyes and the second applicator includes a brush for applying mascara. The brush comprises a plurality of bristles and the bristles permanently extend outwardly from the hollow elongated shaft.

In one aspect, the multi-purpose makeup applicator further comprises a twist and slide mechanism, located within the handle, for retracting and extending the elongated member within the hollow elongated shaft. The twist and slide mechanism includes an inner cap having a slot extending angularly upward and around the inner cap from a first point to a second point; and a pair of O-rings located in a pair of pockets located within the elongated member to facilitate sliding of elongated member within the hollow elongated shaft.

In one aspect, the first end of the elongated member includes a protrusion adapted to couple to, and move within, the slot.

In one aspect, the multi-purpose makeup applicator further includes a container for inserting the hollow elongated shaft where the container is a reservoir for holding a cosmetic product.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

The following detailed description is of the best currently contemplated modes of carrying out the disclosed approach. The description is not to be taken in a limiting sense, but is made merely for the purpose of illustrating the general principles of the disclosed approach.

In the following description, certain terminology is used to describe certain features of one or more aspects of the disclosed approach. For example, the term "retractable" refers to an object that can be in at least two different positions. Specifically, the term "retractable" refers to an object that can be retracted or extended, in some aspects. The term "coupling" may refer to direct or indirect coupling. That is, two objects may be coupled to each other even if these two objects are not physically in contact with each other.

First Implementation

Figure 1:
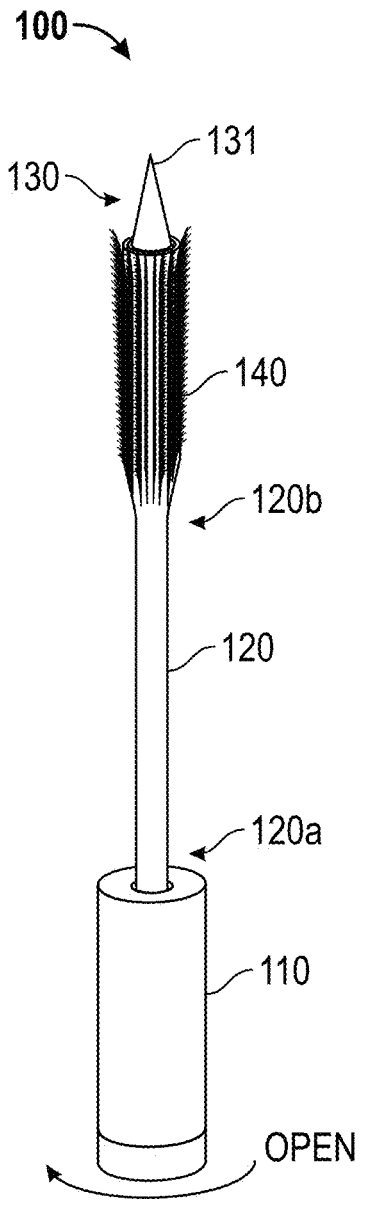
FIG. 1 illustrates a multi-purpose makeup applicator in a first position, according to one aspect.
Figure 2:
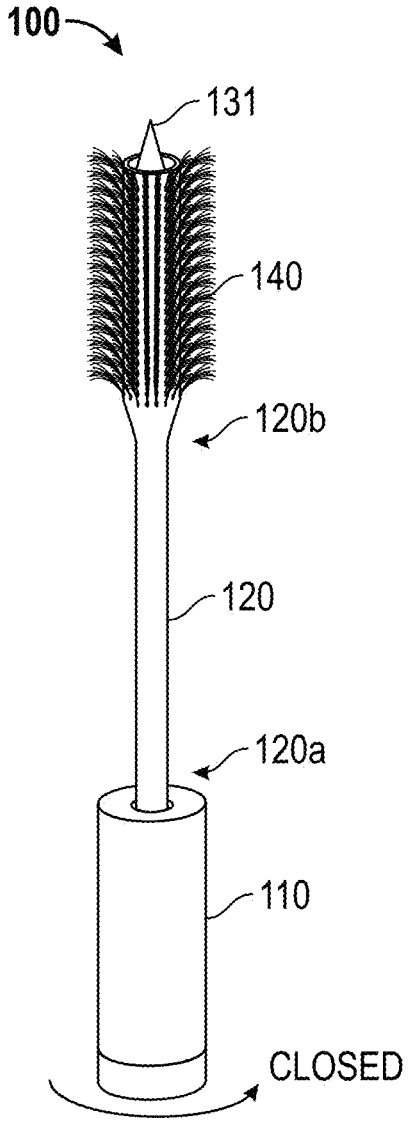
FIG. 2 illustrates the multi-purpose makeup applicator of FIG. 1 in a second position.

FIGS. 1-2 illustrate a multi-purpose makeup applicator, according to one aspect. As shown, the multi-purpose applicator 100 may include a handle 110, a hollow elongated shaft 120 extending longitudinally outward from the handle 110, a first applicator 130 having a first applicator tool 131 located within the hollow elongated shaft 120 and a second applicator 140 formed on the hollow elongated shaft. The hollow elongated shaft 120 may include a proximal end 120*a*, in contact with the handle 110, and an opposite distal end 120*b*.

The first applicator 130 may comprise an elongated member located within the hollow elongated shaft 120, affixed to the handle 110 at one end, and the first applicator tool 131 affixed to a second, opposite end. According to one aspect, the elongated member of the first applicator 130 may be a crayon, a chalk, a lipstick, an eyeliner, or a swab applicator. For example, the first applicator 130 may be a retractable eyeliner tool for applying cosmetics, for example, around the contours of eyes. As shown in FIG. 1, when the handle 110, or a portion of the handle 110, is rotated or twisted in a first direction (open direction), as described in greater detail below, the elongated member of the first applicator 130 may extend axially upwards (or outwards) such that the first applicator tool 131 at the end of the elongated member is exposed for application. As shown in FIG. 2, when the handle 110 is rotated or twisted in a second direction (closed direction), opposite the first direction, the elongated member of the first applicator 130 may retract axially within the hollow elongated shaft 120.

The second applicator, may be coupled to, or formed in, the distal end 120*b* of the elongated shaft 120. According to one aspect, the second applicator 140 may comprise one or more types of bristles or bristle fibers extending outwardly from the hollow elongated shaft 120 forming a brush. The brush may be used for applying cosmetics, such as mascara, to eye lashes. As shown in FIG. 1, when the handle 110 is rotated or twisted in the first direction, as described in greater detail below, the bristles or bristle fibers of the second applicator 140 may be retracted or compressed towards the hollow elongated shaft 120. As shown in FIG. 2, when the handle 110 is rotated or twisted in the second direction, opposite the first direction, the bristles or bristle fibers of the second applicator 140 may project outwardly from the hollow elongated shaft 120 for application.

Referring again to FIG. 1, the multi-purpose makeup applicator 100 is illustrated in a first position. Specifically, FIG. 1 illustrates the multi-purpose applicator 100 in an open position. In the open position, the first applicator 130 is in an extended or protruding position (e.g., maximized position) and the second applicator 140 is in a retracted position (e.g., minimized position). When the first applicator 130 is in the extended position, the first applicator 130 may be positioned mostly (if not entirely) outside of the elongated shaft 120. When the second applicator 140 is in the retracted position, the second applicator may be positioned mostly (if not entirely) inside the elongated shaft 120. As shown in FIG. 1, in the extended position, the first applicator 130 may extend outwardly from the elongated shaft 120 through a hole at the top of the elongated shaft 120 such that the first applicator tool 131 is visible. In some aspects, the first applicator 130 may extend outwardly from the elongated shaft 120 through a slit at the top of the shaft 120. One advantage of using a slit over a hole is that the slit may securely close or cover the elongated shaft 120 when the first applicator 130 is in the retracted position.

As described above, in some aspects, when the multi-purpose applicator 100 is in the open position, the multi-purpose tool 100 may primarily be used as an eyeliner tool. In the open position, the first applicator tool 131 of the first applicator 130 may be located outside the elongated shaft 120 and therefore available for use, in some aspects. However, in the open position, the second applicator 140 may be located inside (or retracted into) the elongated shaft 120 and therefore cannot be used as a mascara applicator.

Referring again to FIG. 2, the multi-purpose makeup applicator 100 is illustrated in a second position. Specifically, FIG. 2 illustrates the multi-purpose tool 100 in a closed position. In the closed position, the first applicator 130 may be in a retracted position (e.g., minimized position) and the second applicator 140 may be in an extended or protruding position (e.g., maximized position). When the first applicator 130 is in the retracted position, the first applicator 130, including the first applicator tool 131, may be positioned mostly (if not entirely) inside the elongated shaft 120. When the second applicator 140 is in the extended position, the second applicator 140 may be positioned mostly (if not entirely) outside of the elongated shaft 120. As shown in FIG. 2, in the extended position, the bristles of the second applicator 140 may extend outwardly from the elongated shaft 120 through several holes located around the distal end 120*b* in the elongated shaft 120.

As described above, in some aspects when the multi-purpose applicator 100 is in the closed position, the multi-purpose tool 100 may primarily be used as a mascara applying tool. In the closed position, the first applicator tool 131 and the first applicator 130 may be located inside the shaft 120 and therefore not available for use, in some aspects. However, in the closed position, the second applicator 140 may be located outside of the elongated shaft 120 and therefore the multi-purpose applicator 100 can be used as a mascara applicator. In addition, in the closed position, the multi-purpose applicator 100 can be stored in a container, such as a removable cap.

Figure 3:
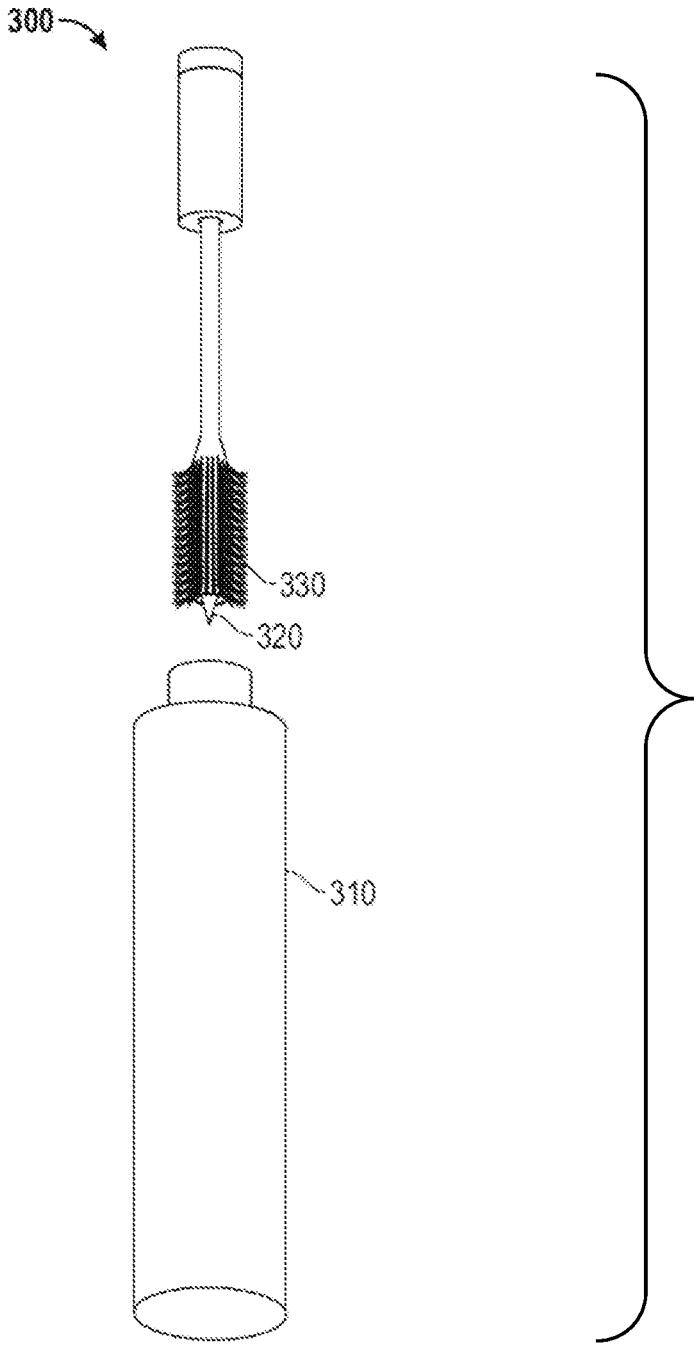
FIG. 3 illustrates an example how to use and/or store a multi-purpose makeup applicator when the multi-purpose makeup applicator is in the closed position.

FIG. 3 illustrates an example of how to use and/or store a multi-purpose makeup applicator when the multi-purpose makeup applicator is in the closed position. As shown in this figure, the multi-purpose applicator 300 may be inserted in a container, or removable cap, 310. According to one aspect, the container 310 may be a mascara tube or reservoir for holding mascara. As described above, the multi-purpose applicator 300 may comprise a first applicator 320, having a first applicator tool, and a second applicator 330 (which includes bristles in some aspects). Both the first applicator 320 and the second applicator may be retractable applicators.

As further shown in FIG. 3, the first applicator 320 may be in the retracted position, while the second applicator 330 is in the extended position. When the multi-purpose applicator 300 is inserted in the container 310, the second applicator 330 may pick up some of the mascara stored in the container 310. When the multi-purpose applicator 300 is removed from the container 310, the second applicator 330 may have some mascara on it which can then be applied to eyelashes, for example. In addition, when not in use, the multi-purpose applicator 300 may be stored in the container 310. While the multi-purpose applicator 300 is described as being stored in the container 310 while in the closed position, in some aspects, the multi-purpose applicator 300 can also be stored in the container 310 while in the open position.

Referring back to FIGS. 1-2, different aspects may use different mechanisms for retracting and/or extending the first applicator 130 and the second applicator 140 from the elongated shaft 120. For example, a spring based mechanism may be used to retract and/or extend the first applicator 130 and the second applicator 140 is a spring based mechanism. In the spring based mechanism, a spring and a slide mechanism may be used to push or pull the first applicator 130 and the second applicator 140 from the shaft 120. In such instances, the spring and slide mechanism may be located inside the shaft 120 and coupled (either directly or indirectly) to the first applicator 130 and the second applicator 140.

Compressing the spring may cause movement of the slide mechanism in a first direction, while releasing the spring from compression may cause movement of the slide mechanism in a second direction. The second direction may be the opposite direction of the first direction, in some aspects. The movement of the slide mechanism may cause the first applicator 130 and the second applicator 140 to either retract or extend from the elongated shaft 120. In some aspects, compressing the spring may cause the first applicator 130 to retract inside the elongated shaft 120 while the second applicator 140 is extended from the elongated shaft 120. In other aspects, compressing the spring may cause the first applicator 130 to extend from the elongated shaft 120 while the second applicator 140 is retracted inside the elongated shaft 120.

In some aspects, the handle 110 may include a push button that either compresses the spring or releases the spring. Thus, the handle 110 can be used to control the retraction and extension of the first applicator 130 and the second applicator 140.

One or more of the components and functions illustrated in FIGS. 1-3 may be rearranged and/or combined into a single component or embodied in several components without departing from the disclosed approach. While the above multi-purpose applicator is described for use as an eyeliner tool and a mascara applying tool, it may also be used to apply other types of cosmetic products. Also, in some aspects, both the first and second applicators can be retracted or extended from the shaft at the same time.

Additional elements or components may also be added without departing from the disclosed approach. For example, in addition to the slide mechanism, some aspects may also include a reversing mechanism for converting the movement of the slide in one direction into a movement of either the first applicator or second applicator in a direction that is opposite of the direction of the movement of the slide.

Having described an example of one implementation of a multi-purpose tool/applicator, other implementations of a multi-purpose makeup tool/applicator will now be described.

Second Implementation

Figure 4A:
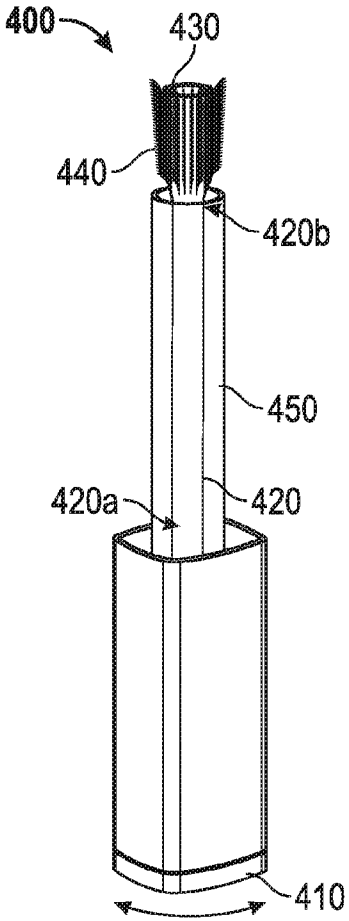
FIGS. 4A, 4B and 4C illustrate a sequence of operations of a multi-purpose makeup applicator, according to one aspect.
Figure 4B:
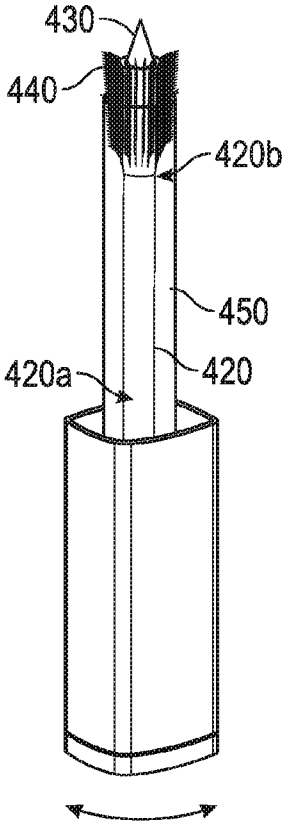
Figure 4C:
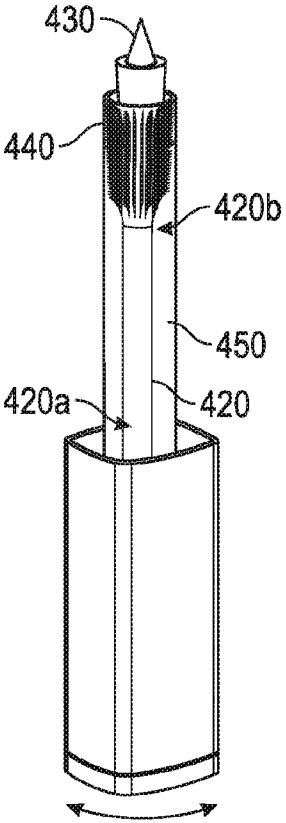

FIGS. 4A, 4B and 4C illustrate a sequence of operations of a multi-purpose makeup applicator, according to one aspect. As shown in FIGS. 4A, 4B and 4C, the multi-purpose applicator 400 may include a handle 410, a hollow elongated shaft 420 extending longitudinally outward from the handle 410, a first applicator 430 located within the hollow elongated shaft 420, a second applicator 440 formed on the hollow elongated shaft 420 and a shell 450. The hollow elongated shaft 420 may include a proximal end 420*a*, in contact with the handle 410, and an opposite distal end 420*b*. According to one aspect, at least part of the handle 410 can be twisted. The shell 450 may be coupled to the handle 410 and may encapsulate at least part of the shaft 420.

The first applicator 430 may comprise an elongated member, affixed to the handle 410 at one end, and an applicator tool affixed to a second, opposite end. According to one aspect, the elongated member of the first applicator 430 may be a crayon, a chalk, a lipstick, an eyeliner, or a swab applicator. For example, the first applicator 430 may be a retractable eyeliner tool for applying cosmetics, for example, around the contours of eyes.

The second applicator 440 may be coupled to, or formed in, the distal end 420*b* of the elongated shaft 420. According to one aspect, the second applicator 440 may comprise one or more types of bristles or bristle fibers extending outwardly from the hollow elongated shaft 410 forming a brush. The brush may be used for applying cosmetics, such as mascara, to eye lashes.

In Step 1 of the sequence of operations of a multi-purpose makeup applicator as shown in FIG. 4A, the shell 450 may cover part of the elongated shaft 420. In this position, the second applicator 440 may be in an extended position, while the first applicator 430 may be in a retracted position. In this retracted position, the first applicator 430 may not be visible in some implementations.

In Step 2 of the sequence of operations of a multi-purpose makeup applicator as shown in FIG. 4B, the shell 450 may cover at least part of the second applicator 440. In this step, the second applicator 440 may be partially in an extended position. In this position, part of the second applicator 440 is visible. Also, in Step 2, the first applicator 430 may be partially in an extended position. In this position, part of the first applicator 430 may be visible. The first applicator 430 may extend from a hole or slit from the top of the elongated shaft 420. In some aspects, Step 2 may occur when the handle 410 is twisted (e.g., clockwise, counter clockwise).

In Step 3 of the sequence of operations of a multi-purpose makeup applicator as shown in FIG. 4C, the shell 450 may cover the second applicator 440. In this position, the second applicator 440 may be in a retracted position. Step 3 also illustrates that the first applicator 430 may be in a protruded position. In this protruded position, the first applicator 430 has fully extended from the elongated shaft 420 (e.g., through a hole or slit of the elongated shaft 420). As mentioned above, the first applicator 430 may be in the protruded position when the handle 410 is twisted in a particular direction (e.g., clockwise, counter clockwise).

Figure 5:
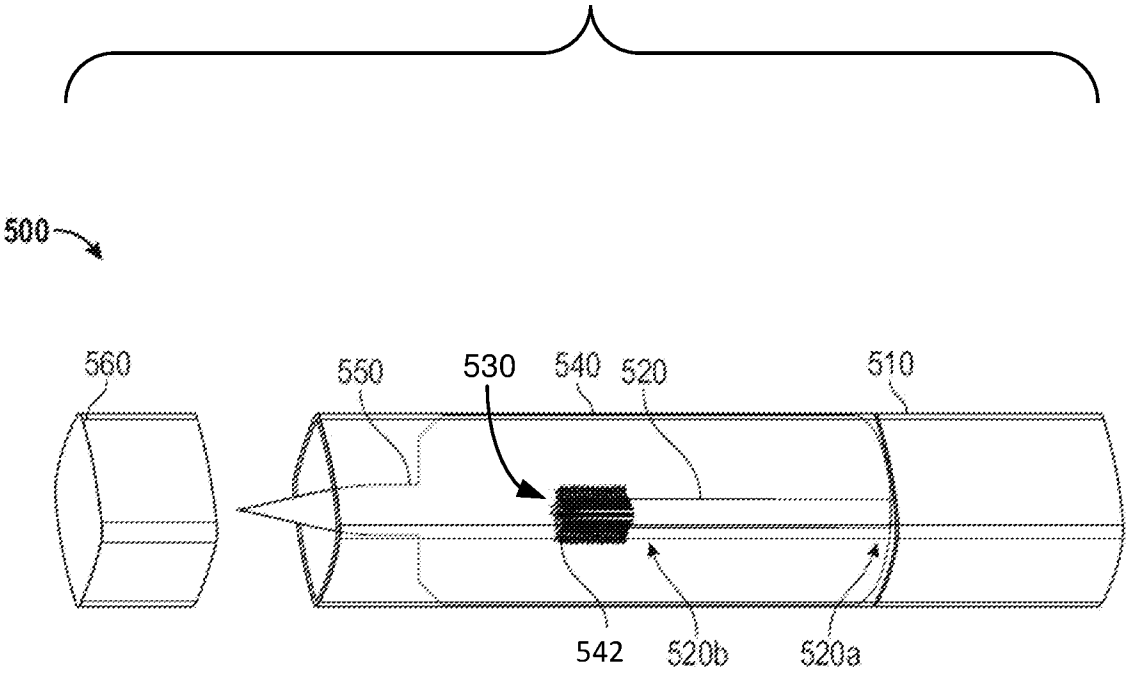
FIG. 5 illustrates a multi-purpose makeup applicator, according to one aspect.

FIG. 5 illustrates a multi-purpose makeup applicator 500, according to one aspect. The multi-purpose applicator 500 may include a handle 510, a hollow elongated shaft 520 extending longitudinally outward from the handle 510, a first applicator 530 located within the hollow elongated shaft 520, a second applicator 542 formed on the hollow elongated shaft 520, and a container, or reservoir, 540 for storing cosmetics.

The hollow elongated shaft 520 may include a proximal end 520*a*, in contact with the handle 510, and an opposite distal end 520*b*. According to one aspect, at least part of the handle 510 can be twisted. The multi-purpose applicator 500 may be similar to the applicators described in FIGS. 1-4. However, FIG. 5 illustrates the multi-purpose applicator 500 with a valve 550 that allows liquid (e.g., mascara) within the container 540 to be released. Different aspects may use different types of valves. The valve 550 may be a pressure sensitive valve in some aspects. The valve 550 may be covered up by a cap 560.

Having described various multi-purpose makeup applicators in general terms. A specific multi-purpose makeup applicator will now be described.

Figure 6:
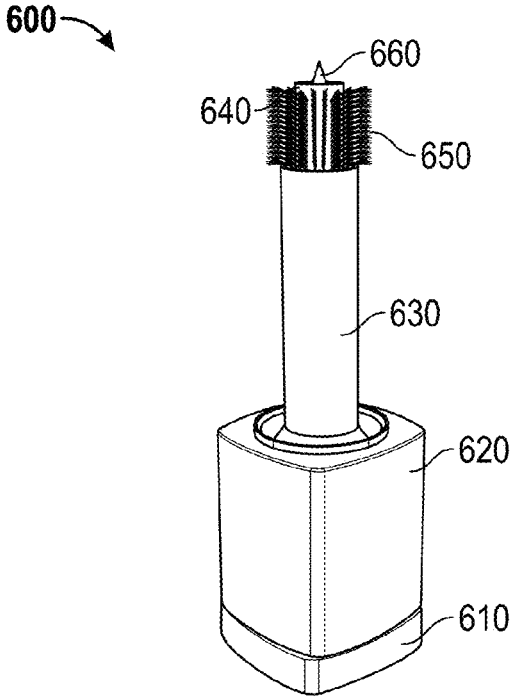
FIG. 6 illustrates a multi-purpose makeup applicator, according to one aspect.

FIG. 6 illustrates a multi-purpose makeup applicator 600 showing first and second applicators 650 and 660 partially extended, according to one aspect. The multi-purpose applicator includes a handle 610, a cover 620, a shell 630, a shaft 640, a first applicator 650 and a second applicator 660. The multi-purpose makeup applicator 600 may be similar to the applicators described in FIGS. 1-5 and the first applicator 650 may be utilized for applying mascara in some implementations and the second applicator 660 may be utilized for applying eyeliner in some implementations. The first and second applicators 650 and 660 may be coupled to the shaft 640.

Figure 7:
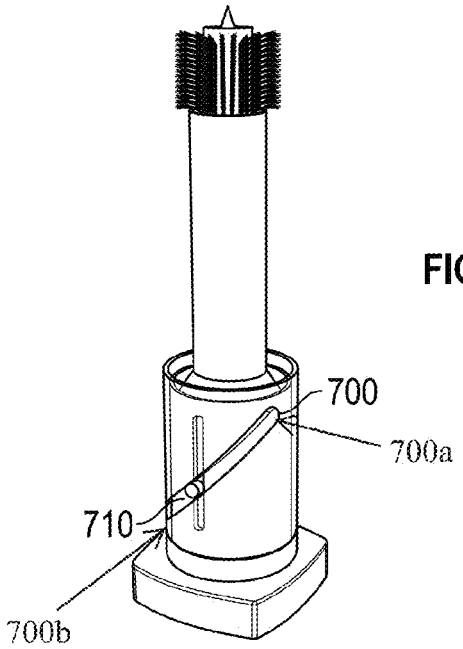
FIG. 7 illustrates the multi-purpose makeup applicator of FIG. 6 without the cover.

FIG. 7 illustrates the multi-purpose makeup applicator 600 of FIG. 6 without the cover 620 for purposes of illustrating a guiding component. As shown in FIG. 7, the multi-purpose applicator 600 may include a guiding component 700. The guiding component 700 may include a slot 710. The slot 710 may be an elongated opening along the surface of the guiding component 700. In this instance, the guiding component 700 has a circular profile. As such, the slot 710 may be along the circumference of the guiding component 700. As shown in FIG. 7, the slot 710 may have a path that twists about the guiding component 700. The path of the slot 710 may extend from a bottom portion 700*a* of the guiding component 700 to a top portion 700*b* of the guiding component 700. In some implementations, the guiding component 700 may be used to help extend and retract the first and second applicators (e.g., applicators 650-660). In some instances, the guiding component 700 may be used to help move the shell 630. The movement of the shell 630 may also cause the movement of at least one of the applicators (e.g., the second applicator 660, which is coupled to the shell 630 in some aspects).

Figure 8:
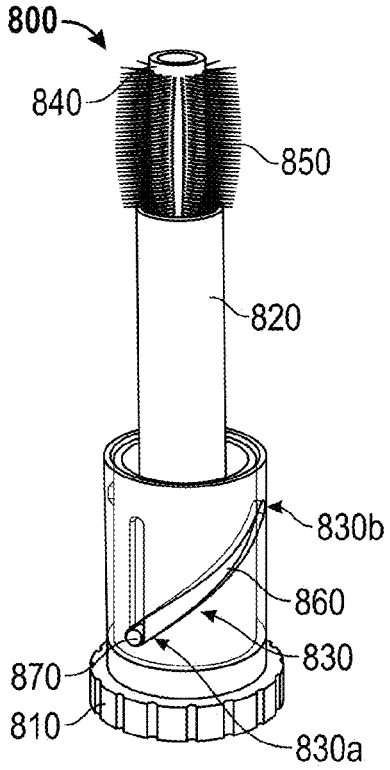
FIG. 8 illustrates a multi-purpose makeup applicator in a first position, according to one aspect.

FIG. 8 illustrates a multi-purpose makeup applicator 800 in a first position, according to an aspect. As shown in this figure, the multi-purpose applicator 800 may include a base portion 810, a shell 820, a guiding component 830, a shaft 840 and a first applicator 850. The multi-purpose applicator 800 may also include a second applicator (which is not visible). In some aspects, the base portion 810 may be coupled to a handle (e.g., handle 610). The base portion 810 may be coupled to the shaft 840 and the shaft 840 may be coupled to the first applicator 850. The first applicator 850 may include bristles (which may be used to apply mascara, for example, in some aspects). The guiding component 830 may include a slot 860. The slot 860 may be located about the surface of the guiding component 830 and extend to/from a bottom portion 830*a* of the guiding component 830 and a top portion 830*b* of the guiding component 830.

As shown in FIG. 8, the shell 820 may include a protrusion 870. The protrusion 870 may extend from the outer surface of the shell 820. The protrusion 870 may be designed to couple to the guiding component 830 via the slot 860. The protrusion 870 may be further designed to move about/within the slot 860. As shown in FIG. 8, the protrusion 870 may be located in the bottom portion of the slot 860. When the protrusion 870 is located in the bottom portion of the slot 860, the first applicator 850 may be uncovered, which means the bristles are exposed and the first applicator 850 is in a protruded position. In such instance, the multi-purpose applicator 800 can be used as a mascara applicator. Moreover, in this position, the second applicator (which is not visible) is in the retracted position.

Figure 9:
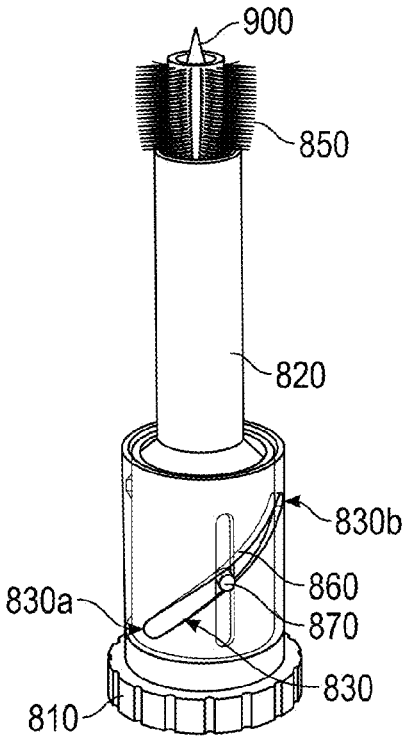
FIG. 9 illustrates the multi-purpose makeup applicator of FIG. 8, in a second position.

FIG. 9 illustrates the multi-purpose applicator 800 in another position. In this position, the first applicator 850 is partially covered by the shell 820. In addition, a second applicator 900 is visible and extends from the shaft 840 through an opening (e.g., hole, slit) in the shaft 840. The second applicator 900 may be an eyeliner in some aspects. Moreover, in this position, the protrusion 870 may be located about midway along the slot 860. As a result of this movement, the shell 820 may be moved upwards, which causes the shell 820 to cover part of the first applicator 850. The movement of the shell 820 may cause the second applicator 900 to protrude. The second applicator 900 may protrude because the second applicator 900 is coupled to the shell 820 in some aspects. In some implementations, a rotation of the base portion 810 may cause the shell 820 to move upwards as the protrusion 870 moves in an upward direction within the slot 860 forcing the exposure of the second applicator 900 while retracting into the first applicator 850. The rotation of the base portion 810 may be caused by a twisting of a handle that is coupled to the base portion 810.

Figure 10:
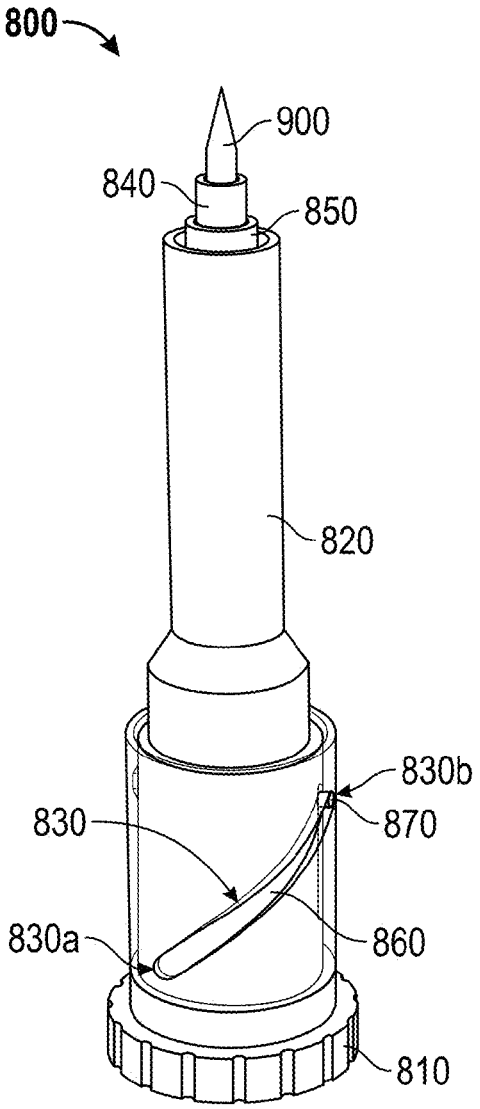
FIG. 10 illustrates the multi-purpose makeup applicator of FIG. 8 in a third position.

FIG. 10 illustrates the multi-purpose applicator 800 in yet another position. In this position, the first applicator 850 is essentially fully covered by the shell 820. In addition, the second applicator 900 is fully extended from the shaft 840 through the opening (e.g., hole, slit) in the shaft 840. Moreover, in this position, the protrusion 870 may be located about the top portion of the slot 860. In this position, the multi-purpose applicator 800 may be used as eyeliner in some aspects.

In some aspects, the mechanism for retracting and/or extending (or protruding) one or more of the applicators includes the shell 820, the guiding component 830, the slot 860 and the protrusion 870. This retraction/extension mechanism may also include the shaft 840 and the handle (e.g., handle 610).

Figure 11:
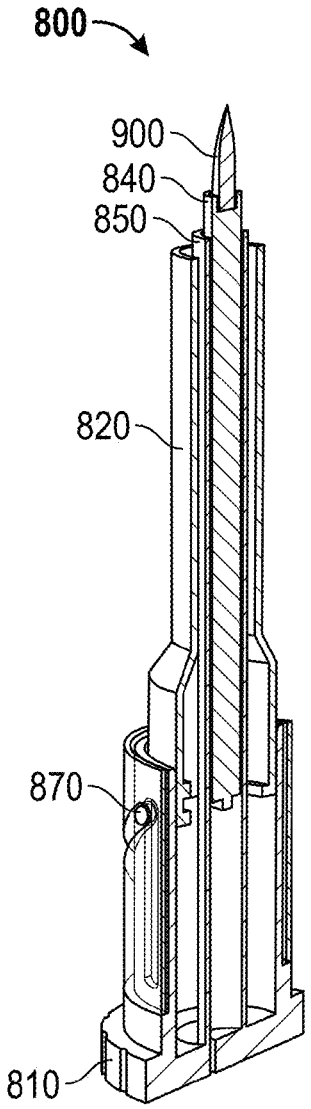
FIG. 11 illustrates a cross section of the multi-purpose makeup applicator of FIG. 10.

FIG. 11 illustrates a cross section of the multi-purpose applicator 800 in some aspects. Specifically, FIG. 11 illustrates the cross section of the multi-purpose applicator of FIG. 10.

Figure 12:
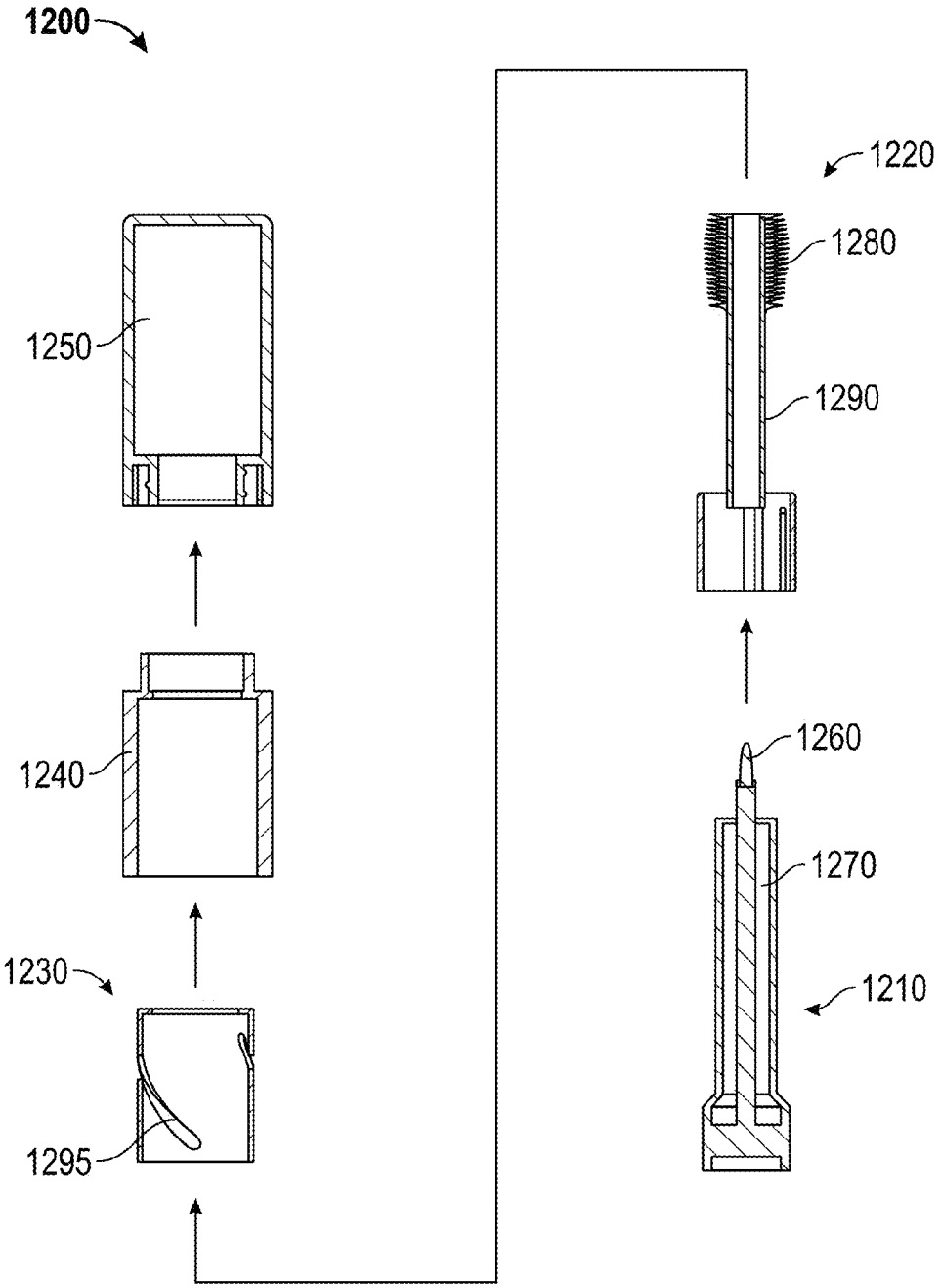
FIG. 12 illustrates an example of how a multi-purpose makeup applicator may be assembled.
Figure 13B:
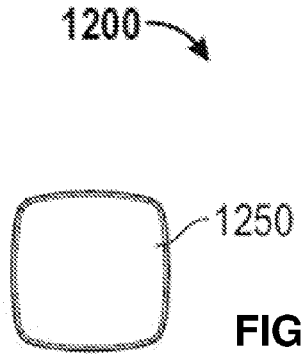
FIG. 13B illustrates a top plan view of the assembled multi-purpose makeup applicator of FIG. 13A.
Figure 13C:
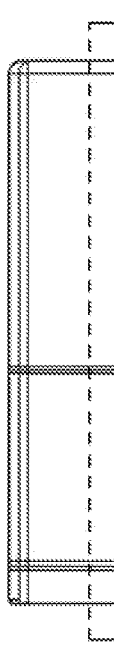
FIG. 13C illustrates a side elevation view of the assembled multi-purpose makeup applicator of FIG. 13A.
Figure 13D:
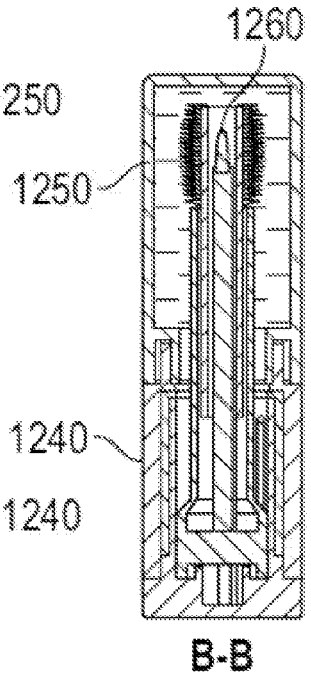
FIG. 13D illustrates a cross section view taken along line B-B of FIG. 13C.
Figure 13A:
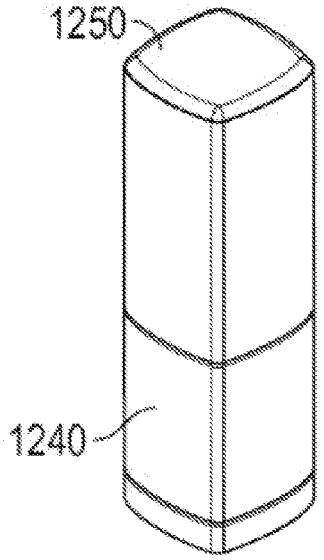
FIG. 13A illustrates a perspective view of the multi-purpose makeup applicator of FIG. 12 after assembly.

FIG. 12 illustrates an example of how a multi-purpose makeup applicator may be assembled. As shown in FIG. 12, a multi-purpose makeup applicator 1200 may include a first component 1210, a second component 1220, a guiding component 1230, a cover 1240 and a cap 1250. The first component 1210 may include a second applicator 1260 and a shell 1270. The second applicator 1260 may be an eyeliner in some aspects. The first component 1210 may also include a protrusion (which is not visible). The protrusion may be a protrusion similar to protrusion 870.

As shown in FIG. 12, the first component 1210 may be coupled to the second component 1220. The second component 1220 may include a first applicator 1280 and a shaft 1290. The first applicator 1280 may include a brush and/or bristles used for applying mascara, according to one example. Once the first and second components 1210 and 1220 are coupled to each other, the first and second components 1210 and 1220 may be coupled to the guiding component 1230. The guiding component 1230 may include a slot 1295 in which the protrusion moves. Next, the first and second component 1210 and 1220 and the guiding component 1230 may be coupled to the cover 1240, which may then be coupled to the cap 1250. The cap 1250 may be used as container for storing liquid/fluid in some implementations. For example, the cap 1250 may be use to store mascara. Thus, the cap 1250 may have a dual purpose, a cap for covering the applicators and a container for storing liquid.

FIG. 13 illustrates the multi-purpose applicator 1200 after assembly in some aspects. Specifically, FIG. 13 illustrates the multi-purpose applicator 1200 after assembly from various views and angles, including a cross-sectional view. As shown in FIG. 13, after assembly, the only thing visible is the cover 1240, the cap 1250 and the handle. In some implementation, the cover 1240 and the cap 1250 are coupled to each other through a locking mechanism and/or snapping mechanism.

Figure 14C:
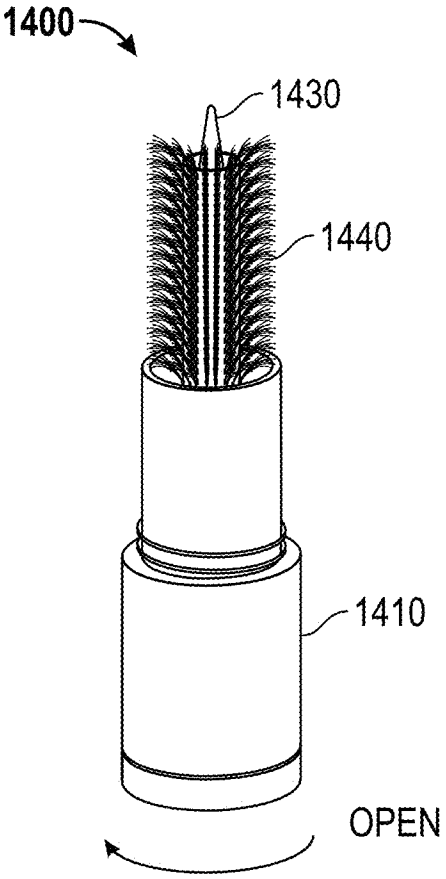
FIG. 14 (comprising FIGS. 14A-14C) illustrates a sequence of operations of a multi-purpose makeup applicator, according to one aspect.
Figure 14B:
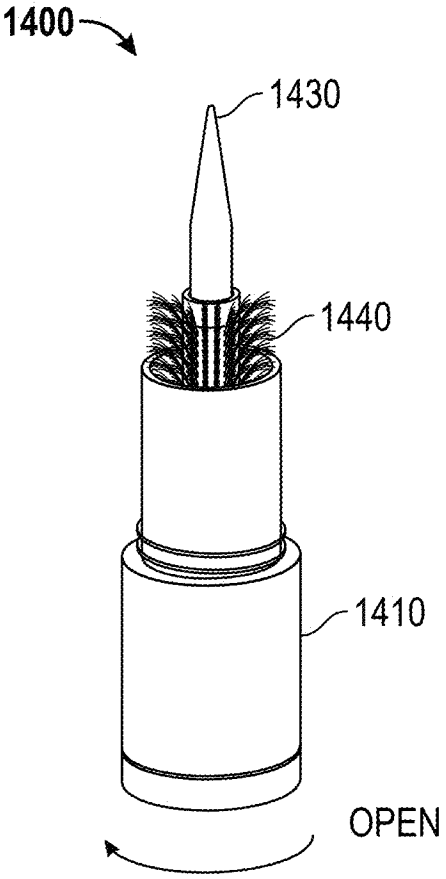
Figure 14A:
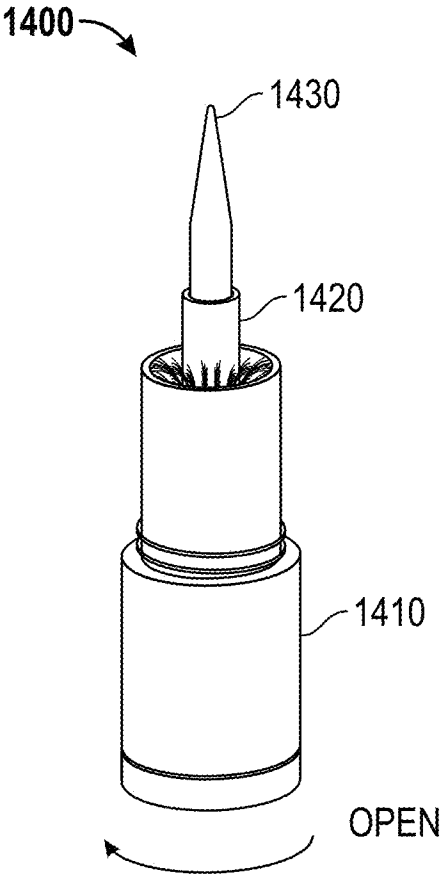

FIG. 14 (comprising FIGS. 14A-14C) illustrates a sequence of operations of a multi-purpose makeup tool 1400, according to one aspect. As shown, the multi-purpose tool 1400 may include a handle 1410, a hollow elongated shaft 1420 extending longitudinally outward from the handle 1410, a first applicator 1430 located within the hollow elongated shaft 1420 and a second applicator 1440 formed on the hollow elongated shaft 1420 as an encasing around the first applicator 1430. The hollow elongated shaft 1420 may include a proximal end, in contact with the handle 1410, and an opposite distal end.

As shown in FIG. 14A, the first applicator 1430 may comprise an elongated member, affixed to the handle 1410 at one end, and an applicator tool affixed to a second, opposite end. According to one aspect, the elongated member of the first applicator 1430 may be a crayon, a chalk, a lipstick, an eyeliner (liquid or solid) or a swab applicator. For example, the first applicator 1430 may be an eyeliner (liquid or solid) tool for applying cosmetics, for example, around the contours of eyes. As shown in FIG. 14B, when the handle 1410, or a portion of the handle 1410, is rotated or twisted in a first direction, as described previously, the elongated member of the first applicator 1430 may be slightly encased axially by the applicator tool, at the end of the elongated member.

As shown in FIG. 14C, the second applicator 1440 (mascara) may be erected axially covering the first applicator 1430 (eyeliner) completely to avoid any smudges from the eyeliner while using/applying the mascara end of the applicator.

As shown in FIG. 14B, when the handle 1410 is rotated or twisted in a second direction, opposite the first direction, the elongated member of the first applicator 1430 may erect axially within the hollow elongated shaft 1440 (mascara).

The second applicator 1440 may be coupled to, or formed in, the handle 1410. When handle 1410 is twisted or rotated in a certain direction, second applicator 1440 may axially erect or retract, within the handle 1410, thus encasing the first applicator 1430.

According the one aspect, the second applicator 1440 may comprise one or more types of bristles or bristle fibers formed on the encasement extending outwards forming as a brush. The brush may be used for applying cosmetics, such as mascara, to eye lashes. As shown in FIGS. 14A and 14B, when the handle 1410 is rotated or twisted in the first direction, as described previously, the bristles on the applicator 1440 are retracted or compressed into the handle 1410, while the first applicator 1430 is exposed. As shown in FIG. 14C, when the handle 1410 is rotated or twisted in the second direction, opposite the first direction, the applicator 1440 with the bristles or bristle fibers may project outwardly from the hollow shaft 1410 for application. For example, if the second direction is counter clock-wise then the first direction is clock-wise, and vice versa.

One or more of the components and functions illustrated in FIGS. 4-14 may be rearranged and/or combined into a single component or embodied in several components without departing from the disclosed approach. While the above multi-purpose makeup applicator is described for use as an eyeliner tool and a mascara applying tool, it may also be used to apply other types of cosmetic products. Additional elements or components may also be added without departing from the disclosed approach. Moreover, different materials may be used to build the components of the multi-purpose tool.

Although the multi-purpose makeup tools (the outer shell casings) described above are shown having a square or round shape, this is by way of example only. In alternative aspects, the multi-purpose makeup tools may be other shapes, such as an oval, hexagon, octagon, or other polygons.

Third Implementation

Figure 18:
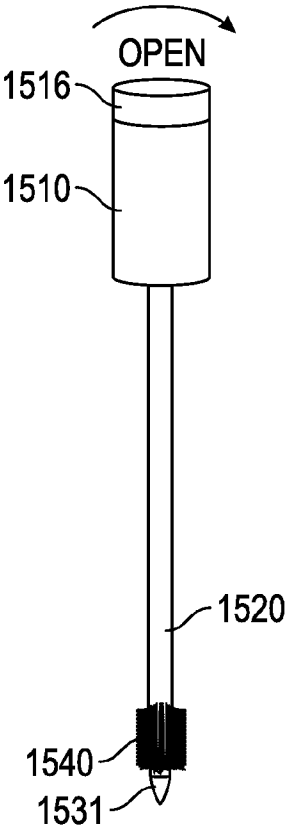
FIG. 18 illustrates the multi-purpose makeup applicator of FIG. 15 in a second position.
Figure 17:
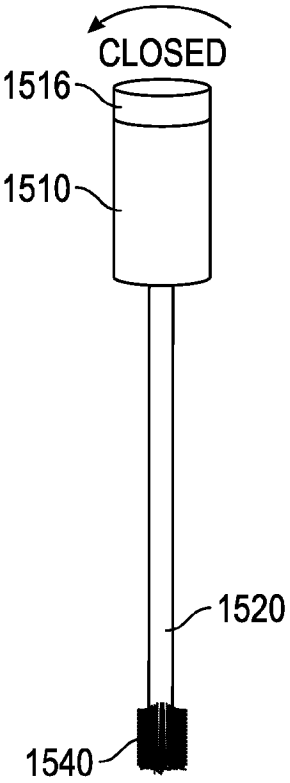
FIG. 17 illustrates the multi-purpose makeup applicator of FIG. 15 in a first position.
Figure 16:
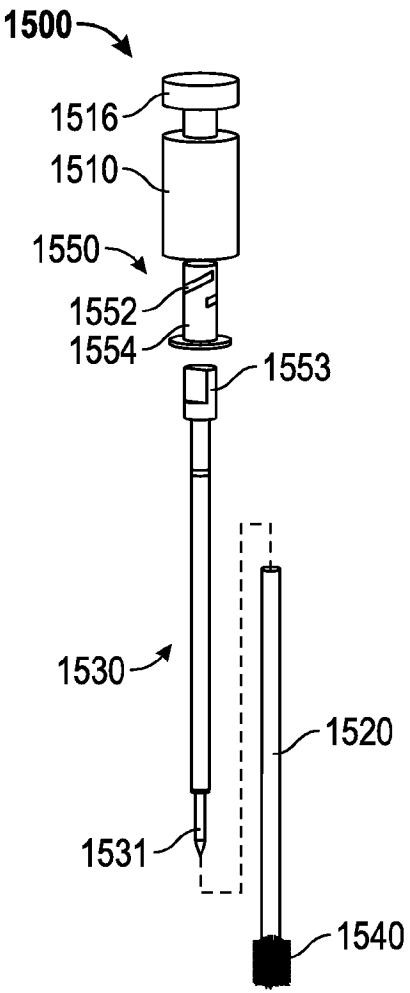
FIG. 16 illustrates an exploded view of the multi-purpose makeup applicator of FIG. 15.
Figure 15:
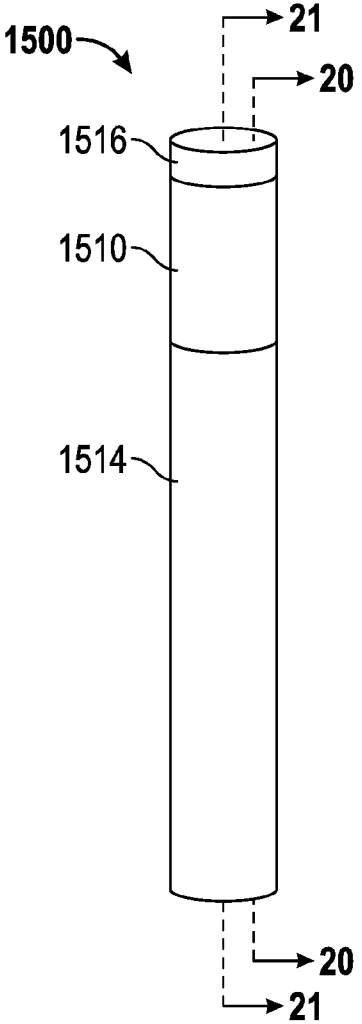
FIG. 15 illustrates a multi-purpose makeup applicator, according to one aspect.
Figures 19A, 19B, 19C, 19D:
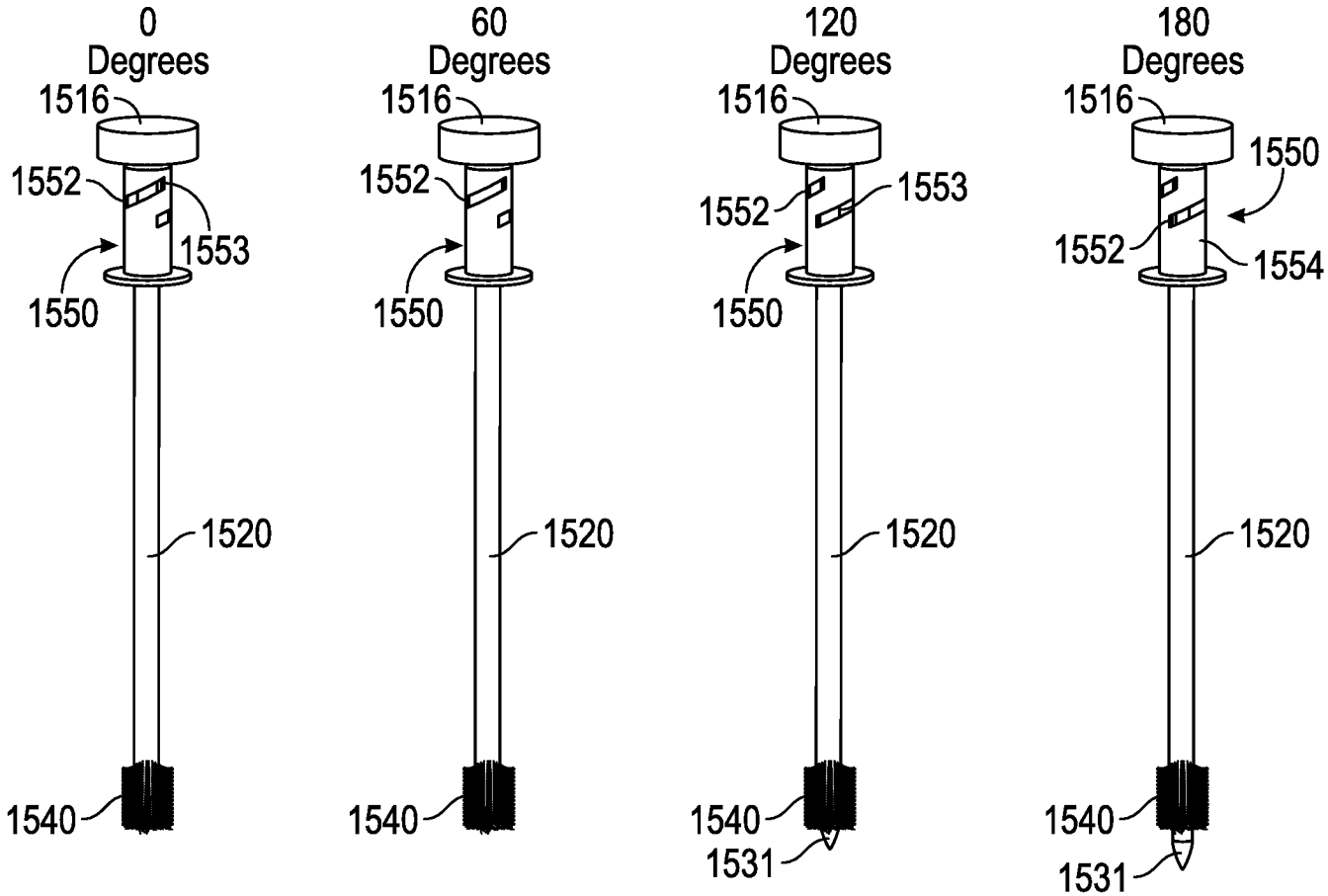
FIG. 19 (comprising FIGS. 19A-19D) illustrates a sequence of operations of the multi-purpose makeup applicator of FIG. 15.
Figure 22:
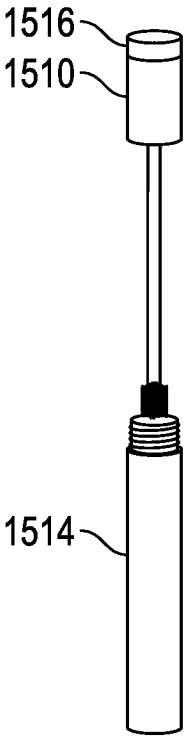
FIG. 22 illustrates an exploded view of the multi-purpose makeup applicator of FIG. 19.
Figure 21:
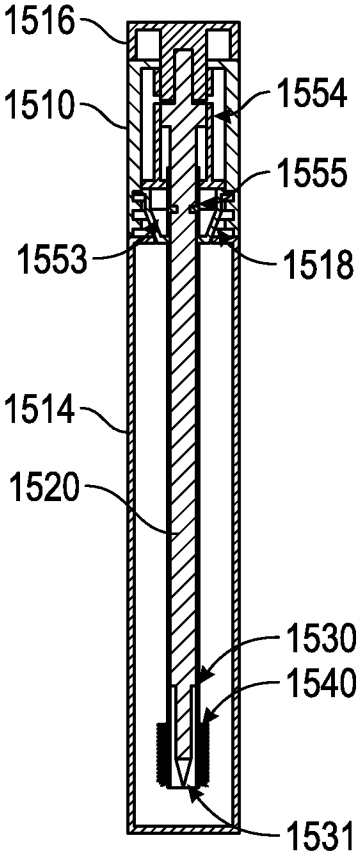
FIG. 21 illustrates a cross-sectional view of the multi-purpose makeup applicator of FIG. 15 taken along line 21-21.
Figure 20:
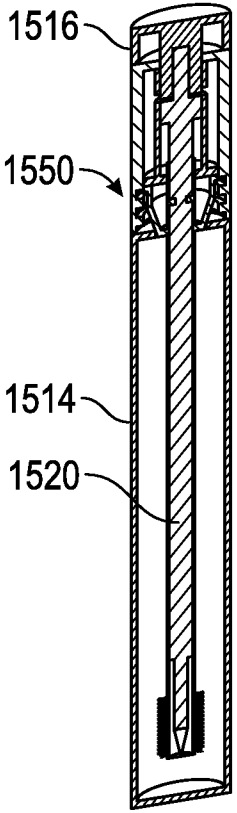
FIG. 20 illustrates a cross-sectional view of the multi-purpose makeup applicator of FIG. 15 taken along line 20-20.

FIG. 15 illustrates a multi-purpose makeup applicator 1500, according to one aspect. FIG. 16 illustrates an exploded view of the multi-purpose makeup applicator 1500 of FIG. 15. FIG. 17 illustrates the multi-purpose makeup applicator of FIG. 15 in a first position, according to one aspect. FIG. 18 illustrates a multi-purpose makeup applicator of FIG. 15 in a second position, according to one aspect. FIG. 19 (comprising FIGS. 19A-19D) illustrates a sequence of operations of the multi-purpose makeup applicator of FIG. 15. FIG. 20 illustrates a cross-sectional view of the multi-purpose makeup applicator of FIG. 15 taken along line 20-20. FIG. 21 illustrates a cross-sectional view of the multi-purpose makeup applicator of FIG. 15 taken along line 21-21. FIG. 22 illustrates an exploded view of the multi-purpose makeup applicator of FIG. 19. The following discussion refers interchangeably to FIGS. 15-22.

Similar to FIG. 1, the multi-purpose makeup applicator 1500 of FIG. 15 may include a handle 1510, a hollow elongated shaft 1520 extending longitudinally outward from the handle 1510, a first applicator 1530 located within the hollow elongated shaft 1520 and a second applicator 1540 formed on the hollow elongated shaft. The hollow elongated shaft 1520 may include a proximal end, in contact with the handle 1510, and an opposite distal end.

The first applicator 1530 may comprise an elongated member located within the hollow elongated shaft 1520, affixed to the handle 1510 at one end, and an applicator tool 1531 affixed to a second, opposite end. According to one aspect, the elongated member of the first applicator 1530 may be a crayon, a chalk, a lipstick, an eyeliner, or a swab applicator. For example, the first applicator 1530 may be a retractable eyeliner tool for applying cosmetics, for example, around the contours of eyes.

The second applicator 1540 may be coupled to, or formed in, the distal end of the elongated shaft 1520. According to one aspect, the second applicator 1540 may comprise one or more types of bristles or bristle fibers extending outwardly from the hollow elongated shaft 1520 forming a brush. The brush may be used for applying cosmetics, such as mascara, to eye lashes. The bristles or bristle fibers may permanently extend outwardly from the hollow elongated shaft 1520. That is, the bristles or bristle fibers do not retract into the hollow elongated shaft 1520 of the second applicator 1540.

The multi-purpose makeup applicator 1500 may also include a container 1514 for dipping or storing the applicators. For example, the container 1514 may be a mascara tube or reservoir for holding mascara. When the brush on the second applicator 1540 is dipped in the container 1514 that has mascara, the brush picks up the mascara so that mascara may be applied to the eyelashes by brushing the brush with the mascara on the eyelashes.

In some aspects, a twist and slide mechanism may be used to retract and/or extend the first applicator 1530 into, or out of, the elongated shaft 1520. In such an aspect, a twist and slide mechanism 1550 may be located in the handle 1510 and may be coupled (either directly or indirectly) to both the first applicator 1530 and the second applicator 1540. In one aspect, the elongated member of the first applicator 1530 may be affixed to the twist and slide mechanism 1550 in the handle 1510 at one end and an applicator tool 1531 affixed to a second, opposite end. According to one aspect, the elongated member of the first applicator 1530 may be a crayon, a chalk, a lipstick, an eyeliner, or a swab applicator. For example, the first applicator 1530 may be a retractable eyeliner tool for applying cosmetics, for example, around the contours of eyes. As shown in FIG. 18, when the knob 1516 of the handle 1510 is rotated or twisted in a first direction (open direction), the elongated member of the first applicator 1530 may extend axially outwards such that the applicator tool 1531 at the end of the elongated member is exposed for application. As shown in FIG. 17, when the knob 1516 of the handle 1510 is rotated or twisted in a second direction (closed direction), opposite the first direction, the elongated member of the first applicator 1530 may retract axially within the hollow elongated shaft 1520. As described above, the second applicator 1540 may be in a permanently extended position on the hollow elongated shaft 1520.

As shown in FIGS. 16 and 19A-D, the twist and slide mechanism 1550 may include an inner cap 1554 having a guiding component 1552 in the form of a slot. The slot may be an elongated opening extending angularly upward and around the inner cap 1554, from a first point on a first end of the inner cap 1554 to a second point on a second, opposite end, of the inner cap 1554. Rotation of a knob 1516 may cause a linear movement of the first end of the elongated member of the first applicator 1530 within elongated shaft 1520. For example, rotating or twisting the knob 1516 in a first clock direction (e.g., clockwise) may cause the first applicator 1530 to move or slide in a first linear direction. Alternatively, rotating or twisting the knob 1516 in a second clock direction (e.g., counter clockwise) may cause the first applicator 1530 to move or slide in a second linear direction, which is opposite to the first linear direction, in some aspects. In one aspect, the first end of the elongated member of the first applicator 1530 may include a protrusion 1553 that is designed to couple to the guiding component 1552 and move or slide within the slot.

FIGS. 19A-19D illustrate a sequence of operations of the multi-purpose makeup applicator using the twist and slide mechanism 1550. As shown in FIG. 19A, when the protrusion 1553 is located at a top portion of the slot of the guiding component 1552, the first applicator 1530 is in a retracted position (i.e. not visible) and the second applicator is in a permanently extended position. In such instance, the multi-purpose make-up applicator can be used as a mascara applicator.

Upon twisting the knob 1516 approximately 60 degrees (See FIG. 19B), the protrusion 1553 slides within the slot of the guiding component 1552 causing the first applicator 1530 to begin extending linearly outward from the elongated shaft 1520 of the second applicator 1540. Twisting the knob 1516 another 60 degrees (or 120 degrees total) causes the protrusion 1553 to continue to slide within the slot of the guiding component 1552 and causes the first applicator 1530 to continue extending linearly outward from the elongated shaft 1520 of the second applicator 1540 such that a portion of the applicator tool 1531 of the first applicator 1530 is visible. (See FIG. 19C) Continuing to twist the knob 1516 another 60 degrees (or 180 degrees total) causes the protrusion 1553 to continue to slide within the slot of the guiding component 1552 and causes the first applicator 1530 to extend linearly outward from the elongated shaft 1520 of the second applicator. In such instance, the multi-purpose make-up tool 1500 can be used as an eyeliner applicator or as lipstick, for example. (See FIG. 19D). When in the fully extended position, the first applicator 1530 extends past the mascara bristles of the second applicator 1540 such that when the applicator tool 1531 of the first applicator 1530 is applied around the contours of eyes, the second applicator 1540 does not touch the eyelashes.

FIGS. 20-21 are cross-sectional views of the multi-purpose makeup applicator of FIG. 20 showing the internal construction of the twist and slide mechanism 1550. As shown, the twist and slide mechanism 1550 of the multi-purpose makeup applicator may include a pair of O-rings 1555, such as metal balls, provided in a pair of pockets (or openings) 1553 located within the elongated member of the first applicator 1530. The pair of O-rings facilitates the sliding of elongated member of the first applicator 1530 within the hollow elongated shaft 1520. That is, the pair of O-rings 1555 may allow the first applicator 1530 to slide smoothly and efficiently outward from the hollow elongated shaft 1520. The pressure applied by the pair of O-rings 1555 allows the first applicator 1530 to extend outwardly in a controlled manner.

Additionally, a pair of wipers 1518 may be included inside the container 1514 so that when the applicators are being removed from the container 1514, excess makeup may be wiped off the applicators. For example, when the mascara applicator is being removed from the mascara tube, the mascara bristles come into contact with the pair of wipers 1518 causing the pair of wipers 1518 to wipe away excess mascara to avoid clumping or making a mess.

One or more of the components and functions illustrated in FIGS. 15-22 may be rearranged and/or combined into a single component or embodied in several components without departing from the disclosed approach. While the above multi-purpose makeup applicator is described for use as an eyeliner tool and a mascara applying tool, it may also be used to apply other types of cosmetic products. Additional elements or components may also be added without departing from the disclosed approach. Moreover, different materials may be used to build the components of the multi-purpose tool.

While certain exemplary aspects have been described and shown in the accompanying drawings, it is to be understood that such aspects are merely illustrative of and not restrictive on the broad disclosed approach, and that this disclosed approach is not to be limited to the specific constructions and arrangements shown and described, since various other modifications may occur to those ordinarily skilled in the art.

What is claimed is:

1. A multi-purpose makeup applicator, comprising:

a handle;

an elongated member with a first end affixed to the handle and a second end affixed to a first applicator adapted for applying a first cosmetic product;

a hollow elongated shaft having a proximal end and a distal end, the proximal end in contact with, and extending longitudinally outward from, the handle and a second applicator affixed to the distal end and adapted for applying a second cosmetic product; and a moveable shell covering the second applicator where the movement of the shell causes the first applicator to protrude;

wherein the elongated member is retractably located within the hollow elongated shaft.

2. The multi-purpose makeup applicator of claim 1, further comprising a knob located within the handle, the knob rotatable between an open position and a closed position.

3. The multi-purpose makeup applicator of claim 2, wherein when the knob is in the closed position, the elongated member is in a fully retracted position.

4. The multi-purpose makeup applicator of claim 2, wherein when the knob is in the open position, the elongated member is a fully extended position and the first applicator is exposed for application.

5. The multi-purpose makeup applicator of claim 1, wherein the first applicator is an eyeliner applicator for applying eyeliner around eyes.

6. The multi-purpose makeup applicator of claim 1, wherein the second applicator includes a brush for applying mascara to eyelashes.

7. The multi-purpose makeup applicator of claim 6, wherein the brush comprises a plurality of bristles and the bristles permanently extend outwardly from the hollow elongated shaft.

8. The multi-purpose makeup applicator of claim 1, further comprising a twist and slide mechanism, located within the handle, for retracting and extending the elongated member within the hollow elongated shaft.

9. The multi-purpose makeup applicator of claim 8, wherein the twist and slide mechanism comprises:

an inner cap having a slot extending angularly upward and around the inner cap from a first point to a second point.

10. The multi-purpose makeup applicator of claim 9, wherein the first end of the elongated member includes a protrusion adapted to couple to, and move within, the slot.

11. The multi-purpose makeup applicator of claim 1, further comprising a container for inserting the hollow elongated shaft.

12. The multi-purpose makeup applicator of claim 11, wherein the container is a reservoir for holding a cosmetic product.

13. A multi-purpose makeup applicator, comprising:

a handle;

an elongated member with a first end affixed to the handle and a second end affixed to a first applicator adapted for applying a first cosmetic product;

a hollow elongated shaft having a proximal end and a distal end, the proximal end in contact with, and extending longitudinally outward from, the handle and a second applicator affixed to the distal end and adapted for applying a second cosmetic product;

a moveable shell covering the second applicator where the movement of the shell causes the first applicator to protrude; and a twist and slide mechanism, located within the handle, for retracting and extending the elongated member within the hollow elongated shaft.

14. The multi-purpose makeup applicator of claim 13, wherein the twist and slide mechanism comprises:

an inner cap having a slot extending angularly upward and around the inner cap from a first point to a second point.

15. The multi-purpose makeup applicator of claim 14, wherein the first end of the elongated member includes a protrusion adapted to couple to, and move within, the slot.

16. A multi-purpose makeup applicator, comprising:

a handle;

an elongated member with a first end affixed to the handle and a second end affixed to a first applicator adapted for applying a first cosmetic product;

a hollow elongated shaft having a proximal end and a distal end, the proximal end in contact with, and extending longitudinally outward from, the handle and a second applicator affixed to the distal end and adapted for applying a second cosmetic product; and a moveable shell covering the second applicator where the movement of the shell causes the first applicator to protrude; and a twist and slide mechanism, located within the handle, for retracting and extending the elongated member within the hollow elongated shaft, the twist and slide mechanism comprising:

an inner cap having a slot extending angularly upward and around the inner cap from a first point to a second point.

17. The multi-purpose makeup applicator of claim 16, wherein the first end of the elongated member includes a protrusion adapted to couple to, and move within, the slot.

* * * * *